US006427852B1

(12) United States Patent
Cannon

(10) Patent No.: US 6,427,852 B1
(45) Date of Patent: Aug. 6, 2002

(54) NAPKIN HOLDING DEVICE

(76) Inventor: Leo Von Cannon, 1426 Aspen St., Danville, VA (US) 24540

( * ) Notice: Subject to any disclaimer, the term of this patent is extended or adjusted under 35 U.S.C. 154(b) by 0 days.

(21) Appl. No.: 09/871,787

(22) Filed: Jun. 1, 2001

(51) Int. Cl.[7] ..... A47F 7/00
(52) U.S. Cl. ..... 211/51
(58) Field of Search ..... 211/51, 50, 45, 211/43, 59.3

(56) References Cited

U.S. PATENT DOCUMENTS

| | | | | |
|---|---|---|---|---|
| 163,750 | A | * | 5/1875 | Davis, Jr. |
| 374,467 | A | * | 12/1887 | France |
| 839,625 | A | * | 12/1906 | McPike |
| 1,407,156 | A | * | 2/1922 | Ingram |
| 1,464,074 | A | * | 8/1923 | Horwitt |
| 1,550,544 | A | | 8/1925 | Hansen |
| 1,583,293 | A | * | 5/1926 | Horwitt |
| 1,647,000 | A | | 10/1927 | Hansen |
| 1,702,983 | A | | 2/1929 | Shaffer et al. |
| 3,147,694 | A | * | 9/1964 | Northup |
| 3,473,672 | A | | 10/1969 | Fincher |
| 4,491,242 | A | | 1/1985 | Trinidad |
| 4,580,695 | A | * | 4/1986 | Lum |
| D304,660 | S | | 11/1989 | Lynch |
| 5,487,601 | A | * | 1/1996 | Lucardie |

* cited by examiner

*Primary Examiner*—Alvin Chin-Shue
*Assistant Examiner*—Sarah Purol

(57) ABSTRACT

A napkin holding device for holding a plurality of napkins during windy conditions. The napkin holding device includes a first plate having a top surface, a bottom surface and a peripheral edge extending therebetween. A second plate has an upper side, a lower side and a peripheral edge extending therebetween. A pair of poles each has a first end and a second end. Each of the first ends is attached to the top surface and extends upwardly therefrom. The poles are spaced from each other. The second plate has a pair of holes extending therethrough. The holes are positioned such that each of the poles may extend through one of the holes. The second plate is movable along the poles. Napkins may be positioned between the first and second panels.

7 Claims, 3 Drawing Sheets

NAPKIN HOLDING DEVICE

BACKGROUND OF THE INVENTION

1. Field of the Invention

The present invention relates to napkin holding devices and more particularly pertains to a new napkin holding device for holding a plurality of napkins during windy conditions.

2. Description of the Prior Art

The use of napkin holding devices is known in the prior art. More specifically, napkin holding devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,473,672; U.S. Pat. No. 1,407,156; U.S. Pat. No. 1,550,544; U.S. Pat. No. 1,647,000; U.S. Pat. No. 1,702,983; U.S. Pat. No. 4,491,242; and U.S. Des. Pat. No. 304,660.

While these devices fulfill their respective, particular objectives and requirements, the aforementioned patents do not disclose a new napkin holding device. The inventive device includes a first plate having a top surface, a bottom surface and a peripheral edge extending therebetween. A second plate has an upper side, a lower side and a peripheral edge extending therebetween. A pair of poles each has a first end and a second end. Each of the first ends is attached to the top surface and extends upwardly therefrom. The poles are spaced from each other. The second plate has a pair of holes extending therethrough. The holes are positioned such that each of the poles may extend through one of the holes. The second plate is movable along the poles. Napkins may be positioned between the first and second panels.

In these respects, the napkin holding device according to the present invention substantially departs from the conventional concepts and designs of the prior art, and in so doing provides an apparatus primarily developed for the purpose of holding a plurality of napkins during windy conditions.

SUMMARY OF THE INVENTION

In view of the foregoing disadvantages inherent in the known types of napkin holding devices now present in the prior art, the present invention provides a new napkin holding device construction wherein the same can be utilized for holding a plurality of napkins during windy conditions.

The general purpose of the present invention, which will be described subsequently in greater detail, is to provide a new napkin holding device apparatus and method which has many of the advantages of the napkin holding devices mentioned heretofore and many novel features that result in a new napkin holding device which is not anticipated, rendered obvious, suggested, or even implied by any of the prior art napkin holding devices, either alone or in any combination thereof.

To attain this, the present invention generally comprises a first plate having a top surface, a bottom surface and a peripheral edge extending therebetween. A second plate has an upper side, a lower side and a peripheral edge extending therebetween. A pair of poles each has a first end and a second end. Each of the first ends is attached to the top surface and extends upwardly therefrom. The poles are spaced from each other. The second plate has a pair of holes extending therethrough. The holes are positioned such that each of the poles may extend through one of the holes. The second plate is movable along the poles. Napkins may be positioned between the first and second panels.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new napkin holding device apparatus and method which has many of the advantages of the napkin holding devices mentioned heretofore and many novel features that result in a new napkin holding device which is not anticipated, rendered obvious, suggested, or even implied by any of the prior art napkin holding devices, either alone or in any combination thereof.

It is another object of the present invention to provide a new napkin holding device which may be easily and efficiently manufactured and marketed.

It is a further object of the present invention to provide a new napkin holding device which is of a durable and reliable construction.

An even further object of the present invention is to provide a new napkin holding device which is susceptible of a low cost of manufacture with regard to both materials and labor, and which accordingly is then susceptible of low prices of sale to the consuming public, thereby making such napkin holding device economically available to the buying public.

Still yet another object of the present invention is to provide a new napkin holding device which provides in the apparatuses and methods of the prior art some of the advantages thereof, while simultaneously overcoming some of the disadvantages normally associated therewith.

Still another object of the present invention is to provide a new napkin holding device for holding a plurality of napkins during windy conditions.

Yet another object of the present invention is to provide a new napkin holding device which includes a first plate having a top surface, a bottom surface and a peripheral edge extending therebetween. A second plate has an upper side, a lower side and a peripheral edge extending therebetween. A pair of poles each has a first end and a second end. Each of the first ends is attached to the top surface and extends upwardly therefrom. The poles are spaced from each other. The second plate has a pair of holes extending therethrough. The holes are positioned such that each of the poles may extend through one of the holes. The second plate is movable along the poles. Napkins may be positioned between the first and second panels.

Still yet another object of the present invention is to provide a new napkin holding device that prevents napkins from being blown away during winding conditions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
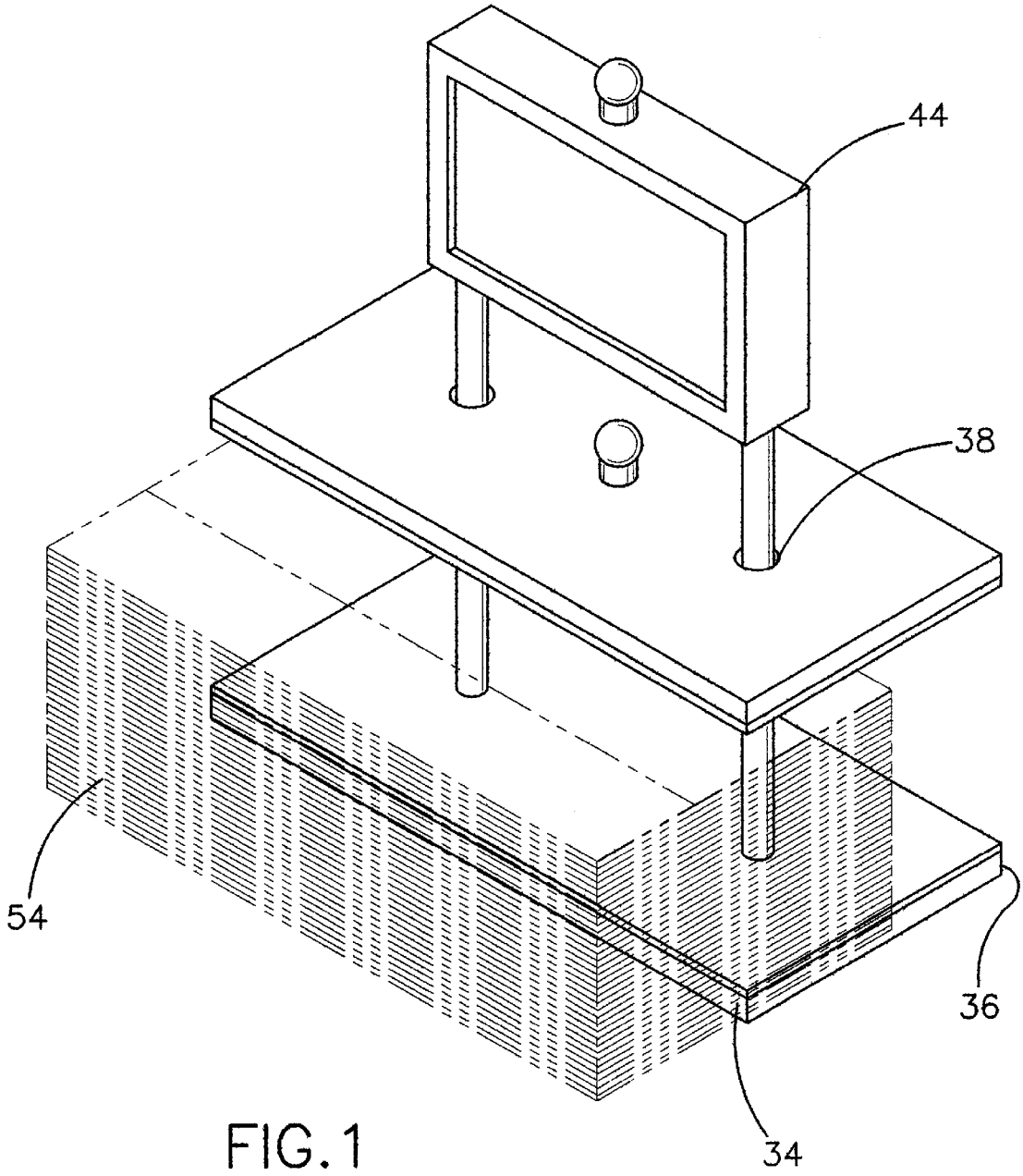
FIG. 1 is a schematic perspective view of a new napkin holding device according to the present invention.
Figure 2:
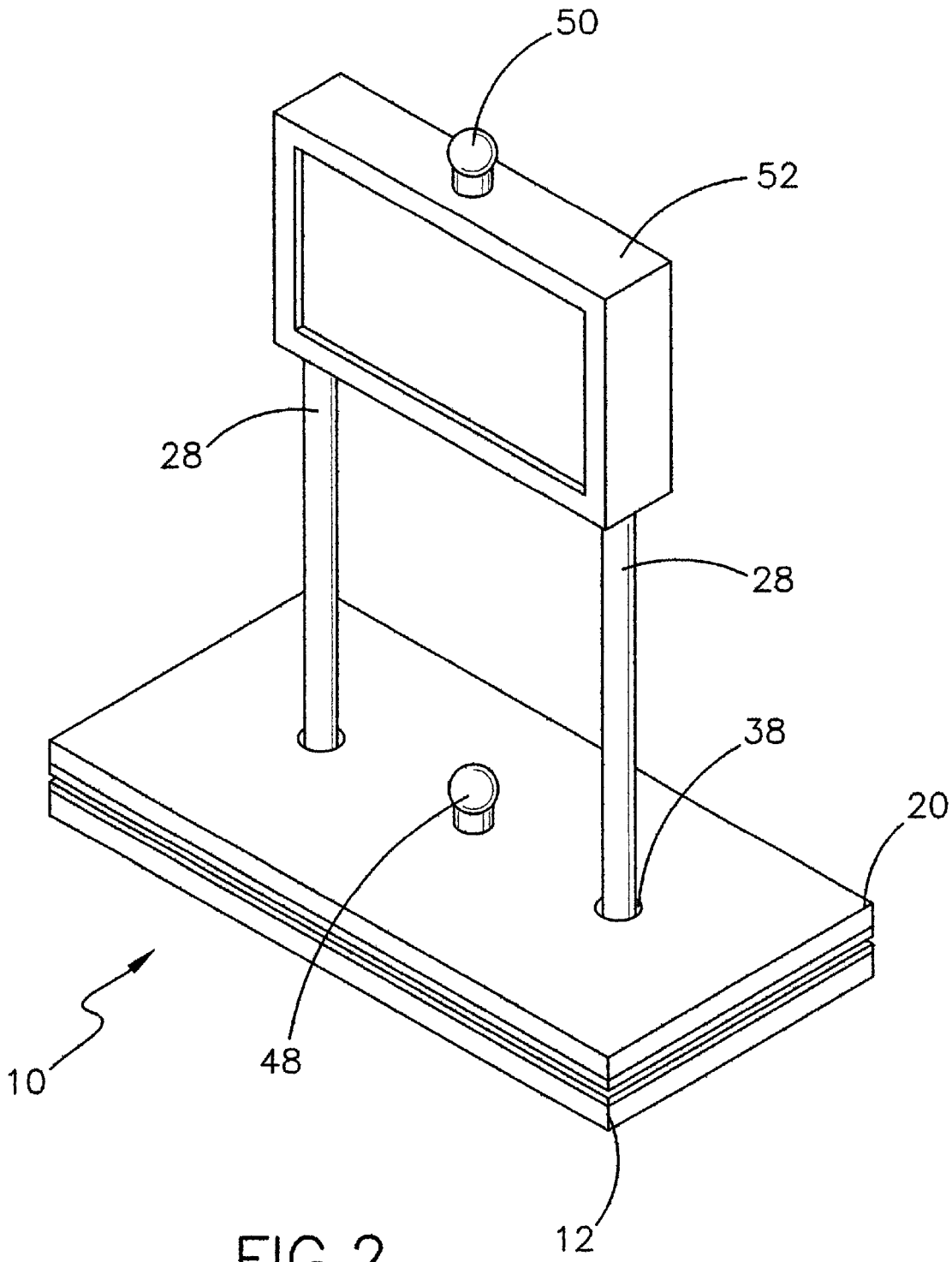
FIG. 2 is a schematic perspective view of the present invention.
Figure 3:
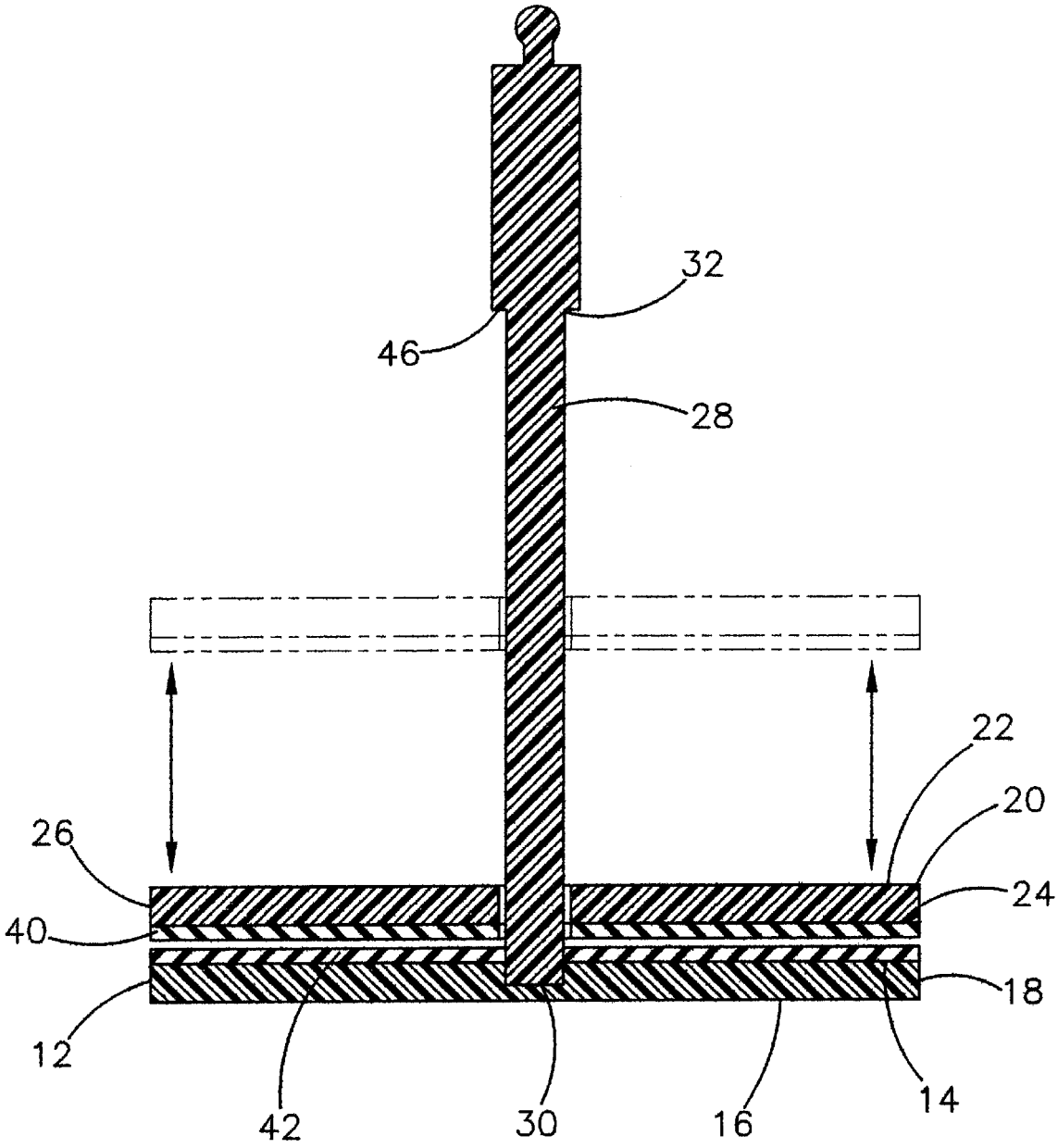
FIG. 3 is a schematic cross-sectional view of the present invention.

With reference now to the drawings, and in particular to FIGS. 1 through 3 thereof, a new napkin holding device embodying the principles and concepts of the present invention and generally designated by the reference numeral 10 will be described.

As best illustrated in FIGS. 1 through 3, the napkin holding device 10 generally comprises a first plate 12 having a top surface 14, a bottom surface 16 and a peripheral edge 18 extending therebetween. The top surface 14 has a generally rectangular shape.

A second plate 20 has an upper side 22, a lower side 24 and a peripheral edge 26 extending therebetween. The lower side 24 of the second plate 20 has a generally rectangular shape.

A pair of poles 28 each has a first end 30 and a second end 32. Each of the first ends 30 is attached to the top surface 14 and extends upwardly therefrom. The poles 28 are positioned between front 34 and back 36 sides of the first plate 12 and are spaced from each other. The second plate 20 has a pair of holes 38 extending therethrough. The holes 38 are positioned such that each of the poles 28 may extend through one of the holes 38. The second plate 20 is movable along the poles 28. The top surface 14 is alignable with the lower side 24.

A first coating 40 is attached to and generally covers the lower side 24 of the second plate 20. The first coating 40 comprises an elastomeric material.

A second coating 42 is attached to and generally covers the top surface 14 of the first plate 12. The second coating 42 comprises an elastomeric material.

A panel 44 has a bottom edge 46 attached to and extends between the second ends 32 of the poles 28. The panel 44 may be used for positioning name plaques thereon.

A nub is 48 attached to and extends upwardly from the upper side 22 of the second plate 20. The nub 48 is positioned between the poles 28. The nub 46 is used for lifting the second plate 20 away from the first plate 12.

A protruding member 50 is attached to and extends upwardly from a top edge 52 of the panel 44. The protruding member 50 is used for lifting the device 10.

In use, napkins 54 may be positioned between the first 12 and second 20 panels. The elastomeric coatings 40, 42 prevent the napkins 54 from slipping out from the plates 12, 20 and prevent their blowing away when in windy conditions.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A napkin holding device for removably holding a plurality of napkins comprising:

a first plate having a top surface, a bottom surface and a peripheral edge extending therebetween;

a second plate having an upper side, a lower side and a peripheral edge extending therebetween;

a pair of poles each having a first end and a second end, each of said first ends being attached to said top surface and extending upwardly therefrom, said poles being spaced from each other, said second plate having a pair of holes extending therethrough, said holes being positioned such that each of said poles may extend through one of said holes, said second plate being movable along said poles;

wherein napkins may be positioned between said first and second panels;

a first coating being attached to and generally covering said lower side of said second plate, said first coating comprising an elastomeric material.

2. The napkin holding device as in claim 1, wherein said first and second plates have a generally rectangular shape, said lower side being generally alignable with said top surface.

3. The napkin holding device as in claim 1, further including:

a second coating being attached to and generally covering said top surface of said first plate, said second coating comprising an elastomeric material.

4. The napkin holding device as in claim 1, further including:

a panel having a bottom edge attached to and extending between said second ends of said poles.

5. The napkin holding device as in claim 1, further including:

a nub being attached to and extending upwardly from said upper side of said second plate, said nub being positioned between said poles.

6. The napkin holding device as in claim 4, further including:

a protruding member being attached to and extending upwardly from a top edge of said panel.

7. A napkin holding device for removably holding a plurality of napkins comprising:

a first plate having a top surface, a bottom surface and a peripheral edge extending therebetween, said top surface having a generally rectangular shape;

a second plate having an upper side, a lower side and a peripheral edge extending therebetween, said lower side of said second plate having a generally rectangular shape;

a pair of poles each having a first end and a second end, each of said first ends being attached to said top surface and extending upwardly therefrom, said poles being positioned between said front and back sides and being spaced from each other, said second plate having a pair of holes extending therethrough, said holes being positioned such that each of said poles may extend through one of said holes, said second plate being movable along said poles, wherein said top surface is alignable with said lower side;

a first coating being attached to and generally covering said lower side of said second plate, said first coating comprising an elastomeric material;

a second coating being attached to and generally covering said top surface of said first plate, said second coating comprising an elastomeric material;

a panel having a bottom edge attached to and extending between said second ends of said poles;

a nub being attached to and extending upwardly from said upper side of said second plate, said nub being positioned between said poles;

a protruding member being attached to and extending upwardly from a top edge of said panel;

wherein napkins may be positioned between said first and second panels.

* * * * *